US011414897B2

(12) United States Patent
Estrada et al.

(10) Patent No.: US 11,414,897 B2
(45) Date of Patent: Aug. 16, 2022

(54) INSIDE RELEASE SPRING FOR VEHICLE DOOR

(71) Applicant: Inteva Products, LLC, Troy, MI (US)

(72) Inventors: Oscar Omar Estrada, Cd. Juarez Chih. (MX); Hector Sanchez, Cd. Juarez Chih. (MX); Fernando Chacon, Cd. Juarez Chih (MX); Carlos Tostado, Cd. Juarez Chih. (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 306 days.

(21) Appl. No.: 16/543,103

(22) Filed: Aug. 16, 2019

(65) Prior Publication Data

US 2020/0056405 A1 Feb. 20, 2020

Related U.S. Application Data

(60) Provisional application No. 62/719,465, filed on Aug. 17, 2018.

(51) Int. Cl.
*E05B 77/26* (2014.01)
*E05B 15/04* (2006.01)

(52) U.S. Cl.
CPC ..... *E05B 77/26* (2013.01); *E05B 15/04* (2013.01); *E05B 2015/0486* (2013.01); *E05Y 2900/531* (2013.01)

(58) Field of Classification Search
CPC ..... Y10T 292/57; Y10T 292/1082; Y10T 292/1047; E05B 77/26; E05B 15/04; E05B 15/104; E05B 2015/0486; E05B 2015/0455; E05B 2015/0403; E05Y 2900/531; Y10S 292/61; Y10S 292/23; E05C 3/22
See application file for complete search history.

(56) References Cited

U.S. PATENT DOCUMENTS 3,049,372 A * 8/1962 Pickles ..... E05B 77/265 292/216
3,923,329 A 12/1975 Torii et al.
4,487,441 A * 12/1984 Miyamoto ..... E05B 77/265 292/216

(Continued)

FOREIGN PATENT DOCUMENTS

DE 4108507 A1 * 9/1992 ..... E05B 77/26
DE 29804649 U1 * 5/1998 ..... E05B 79/20

(Continued)

OTHER PUBLICATIONS

European Search Report for European Application No. 19189173.8, dated Jan. 23, 2020, 4 pages.

*Primary Examiner* — Kristina R Fulton
*Assistant Examiner* — Steven A Tullia
(74) *Attorney, Agent, or Firm* — Cantor Colburn LLP

(57) ABSTRACT

A door inside release spring for a vehicle door assembly includes a torsional spring body, and a first spring arm extending from a first axial end of the spring body. The first spring arm is configured to be operably connected to an inside release lever to bias a position of the inside release lever. A second spring arm extends from a second axial end of the spring body opposite the first axial end. The second spring arm is configured to be operably connected to a child lock lever to bias a position of the child lock lever.

13 Claims, 6 Drawing Sheets

(56) References Cited

U.S. PATENT DOCUMENTS

| | | | | | |
|---|---|---|---|---|---|
| 4,969,673 | A * | 11/1990 | Portelli | E05B 77/265 | 292/216 |
| 5,125,701 | A * | 6/1992 | Hayakawa | E05B 77/265 | 292/336.3 |
| 5,494,322 | A * | 2/1996 | Menke | E05B 77/26 | 292/201 |
| 5,762,383 | A * | 6/1998 | Gomi | E05B 77/26 | 292/216 |
| 6,168,215 | B1 * | 1/2001 | Kodama | E05B 81/06 | 292/201 |
| 8,740,264 | B2 * | 6/2014 | Akizuki | E05B 81/16 | 292/201 |
| 2006/0163883 | A1 * | 7/2006 | Hoshikawa | E05B 77/28 | 292/216 |
| 2006/0163884 | A1 * | 7/2006 | Crotti | E05B 81/25 | 292/216 |
| 2009/0145183 | A1 * | 6/2009 | Maeta | E05C 3/24 | 70/237 |
| 2009/0241617 | A1 * | 10/2009 | Takahashi | E05B 77/28 | 70/257 |
| 2010/0327609 | A1 * | 12/2010 | Akizuki | E05B 81/06 | 292/85 |
| 2013/0056996 | A1 * | 3/2013 | Akizuki | E05B 81/06 | 292/196 |
| 2015/0048632 | A1 * | 2/2015 | Menke | E05B 81/14 | 292/336.3 |
| 2016/0290021 | A1 * | 10/2016 | Nishio | E05B 85/20 | |
| 2017/0191289 | A1 * | 7/2017 | Perkins | E05B 81/06 | |
| 2017/0306661 | A1 * | 10/2017 | Kim | E05B 83/24 | |
| 2017/0314297 | A1 | 11/2017 | Taurasi et al. | | |
| 2018/0112441 | A1 * | 4/2018 | Dam | E05B 77/26 | |
| 2018/0128021 | A1 * | 5/2018 | Akagi | E05B 77/265 | |

FOREIGN PATENT DOCUMENTS

| | | | | | |
|---|---|---|---|---|---|
| DE | 19510337 | C2 * | 3/2000 | E05B 77/265 | |
| DE | 202008012536 | U1 * | 2/2010 | E05B 77/26 | |
| DE | 202010011539 | U1 * | 12/2011 | E05B 77/28 | |
| DE | 202011004952 | U1 * | 7/2012 | E05B 85/26 | |
| DE | 102014114347 | A1 * | 4/2016 | E05B 77/26 | |
| DE | 202015100810 | U1 * | 5/2016 | E05B 81/16 | |
| DE | 102014118399 | A1 * | 6/2016 | E05B 81/66 | |
| DE | 102015004093 | A1 * | 10/2016 | E05B 81/66 | |
| DE | 102015122583 | A1 * | 6/2017 | E05B 17/0037 | |
| EP | 2166181 | A2 * | 3/2010 | E05B 81/16 | |
| EP | 3517716 | A1 * | 7/2019 | E05B 81/25 | |
| FR | 2773836 | A1 * | 7/1999 | E05B 83/36 | |
| FR | 2778198 | A1 * | 11/1999 | E05B 81/16 | |
| FR | 2778198 | | 7/2000 | | |
| FR | 2966490 | A1 * | 4/2012 | E05C 19/145 | |
| FR | 3026767 | A1 * | 4/2016 | E05B 15/04 | |
| GB | 2452373 | A * | 3/2009 | E05B 81/16 | |
| GB | 2483965 | A * | 3/2012 | E05B 81/34 | |
| JP | 2017150173 | A * | 8/2017 | E05B 83/36 | |
| WO | WO-2006000191 | A1 * | 1/2006 | E05B 81/06 | |
| WO | WO-2006054759 | A1 * | 5/2006 | E05B 77/26 | |
| WO | WO-2009066567 | A1 * | 5/2009 | E05B 77/26 | |

* cited by examiner

INSIDE RELEASE SPRING FOR VEHICLE DOOR

CROSS-REFERENCE TO RELATED APPLICATIONS

This application claims the benefit of 62/719,465, filed Aug. 17, 2018, which is incorporated herein by reference in its entirety.

BACKGROUND

The subject matter disclosed herein relates to vehicle doors and, more particularly, to a vehicle door opening mechanism.

Traditional vehicle doors often include a "child lock lever", which controls operation of an inside lock and latch of the door. When the child lock lever is in an engaged position, the door may not be unlatched and opened from the inside of the vehicle.

Requirements for operating effort and functionality of the child lock lever is well defined, and therefore control of manufacturing and installation of the child lock lever is critical to meet these requirements. Typical child lock levers include a beam formed from a plastic material that, in operation, functions as a spring for the child lock lever. This beam retains the child lock lever in either the engaged or disengaged position. The beam, however, results in high variation in operating effort of the child lock lever, and also high variation in the functionality of the lever.

BRIEF DESCRIPTION

In one embodiment, a door inside release spring for a vehicle door assembly includes a torsional spring body, and a first spring arm extending from a first axial end of the spring body. The first spring arm is configured to be operably connected to an inside release lever to bias a position of the inside release lever. A second spring arm extends from a second axial end of the spring body opposite the first axial end. The second spring arm is configured to be operably connected to a child lock lever to bias a position of the child lock lever.

Additionally or alternatively, in this or other embodiments the second spring arm includes a first arm portion extending tangentially from the spring body, a second spring arm tip extending in a direction non-parallel to the first arm portion, and a knee portion connecting the first arm portion and the second spring arm tip.

Additionally or alternatively, in this or other embodiments the second spring arm is configured to bend at the knee portion in response to forces applied at the second spring arm tip.

Additionally or alternatively, in this or other embodiments the first spring arm extends tangentially from the first axial end of the spring body.

Additionally or alternatively, in this or other embodiments the first spring arm is configured to be operably connected to the inside release lever at a first spring arm tip.

In another embodiment, a door latch assembly includes a latch assembly housing, an inside release lever positioned at the latch assembly housing and rotatable about an inside release pivot, a child lock lever positioned at the latch assembly housing and rotatable about a child lock pivot, and a door inside release spring positioned at the housing. The door inside release spring includes a torsional spring body located at the inside release pivot and a first spring arm extending from a first axial end of the spring body. The first spring arm is operably connected to the inside release lever to bias a position of the inside release lever. A second spring arm extends from a second axial end of the spring body opposite the first axial end. The second spring arm is operably connected to the child lock lever to bias a position of the child lock lever.

Additionally or alternatively, in this or other embodiments the second spring arm includes a first arm portion extending tangentially from the spring body, a second spring arm tip extending in a direction non-parallel to the first arm portion, and a knee portion connecting the first arm portion and the second spring arm tip.

Additionally or alternatively, in this or other embodiments the second spring arm is configured to bend at the knee portion in response to forces applied at the second spring arm tip.

Additionally or alternatively, in this or other embodiments the first arm portion abuts a housing rib of the housing, the housing rib reacting loads applied to the second spring arm.

Additionally or alternatively, in this or other embodiments the child lock lever includes a first lock arm positioned in a housing recess, and a second lock arm operably connected to the second spring arm tip.

Additionally or alternatively, in this or other embodiments the second spring arm tip selectably biases the first lock arm toward a first recess end of the housing recess or toward a second recess end of the housing recess.

Additionally or alternatively, in this or other embodiments a direction of the bias of the first lock arm is selected based on a position of the child lock lever relative to child lock pivot.

Additionally or alternatively, in this or other embodiments a lock pin rotates the child lock lever about the child lock pivot.

Additionally or alternatively, in this or other embodiments the first spring arm extends tangentially from the first axial end of the spring body.

Additionally or alternatively, in this or other embodiments the first spring arm is operably connected to the inside release lever at a first spring arm tip.

Additionally or alternatively, in this or other embodiments the child lock pivot and the inside release pivot are separated by a distance.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
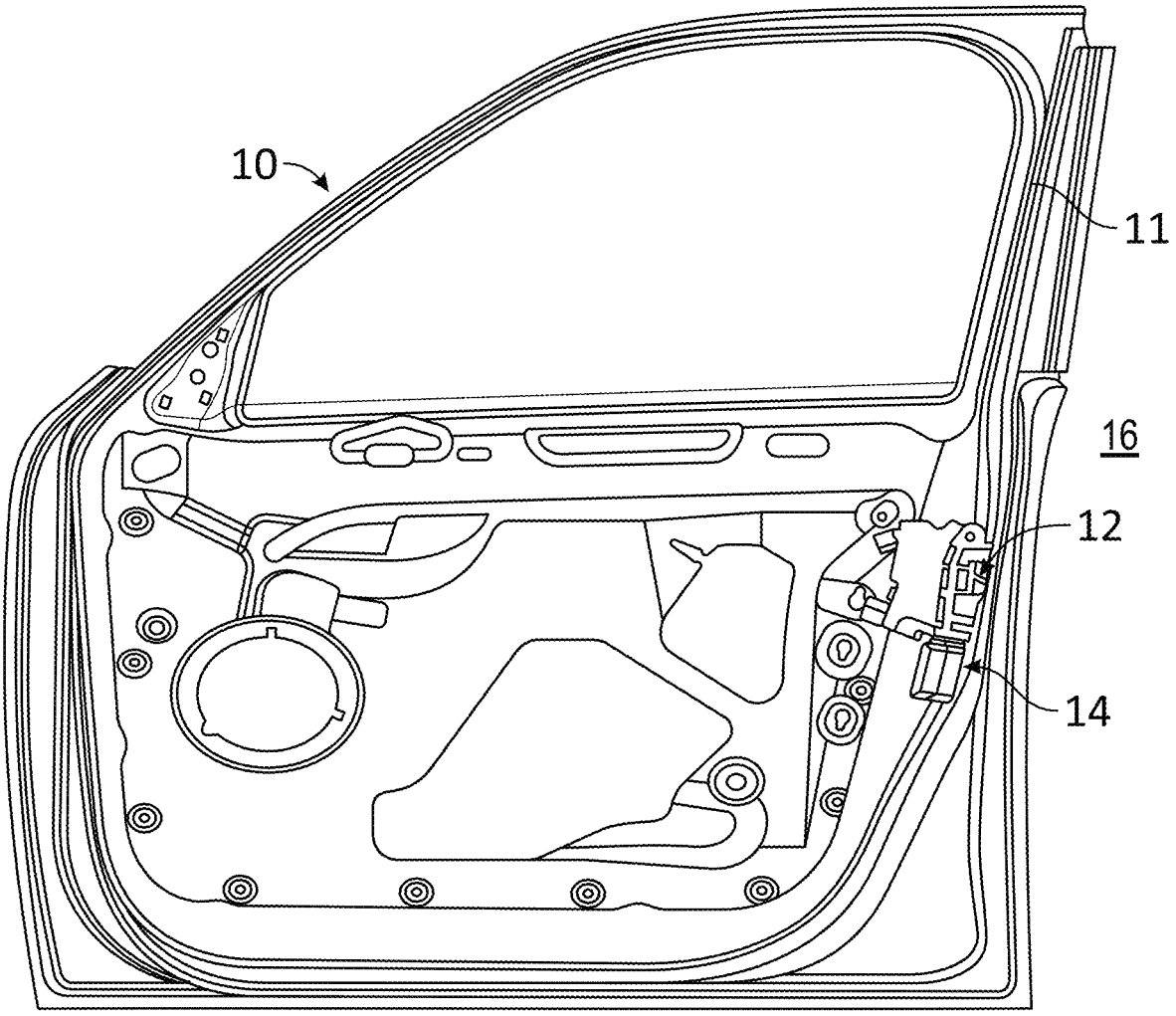
FIG. 1 is an illustration of an embodiment of a vehicle door assembly.

Referring now to FIG. 1, the reference numeral 10 generally designates a vehicle door assembly. The vehicle door assembly 10 may be installed as a driver side door, passenger side door, or rear passenger doors. Additionally, although referred to herein as a vehicle door 11 that is included in the assembly 10, the vehicle door assembly 10 may be installed as a rear door assembly of the vehicle, such as a liftgate, trunk or tailgate, for example. A vehicle latch assembly 12 is operatively coupled to the vehicle door 11 to hold the door (or liftgate, trunk, tailgate, etc.) in a closed position and to release the vehicle door to allow a user to move the vehicle door 11 to an open position.

Figure 2:
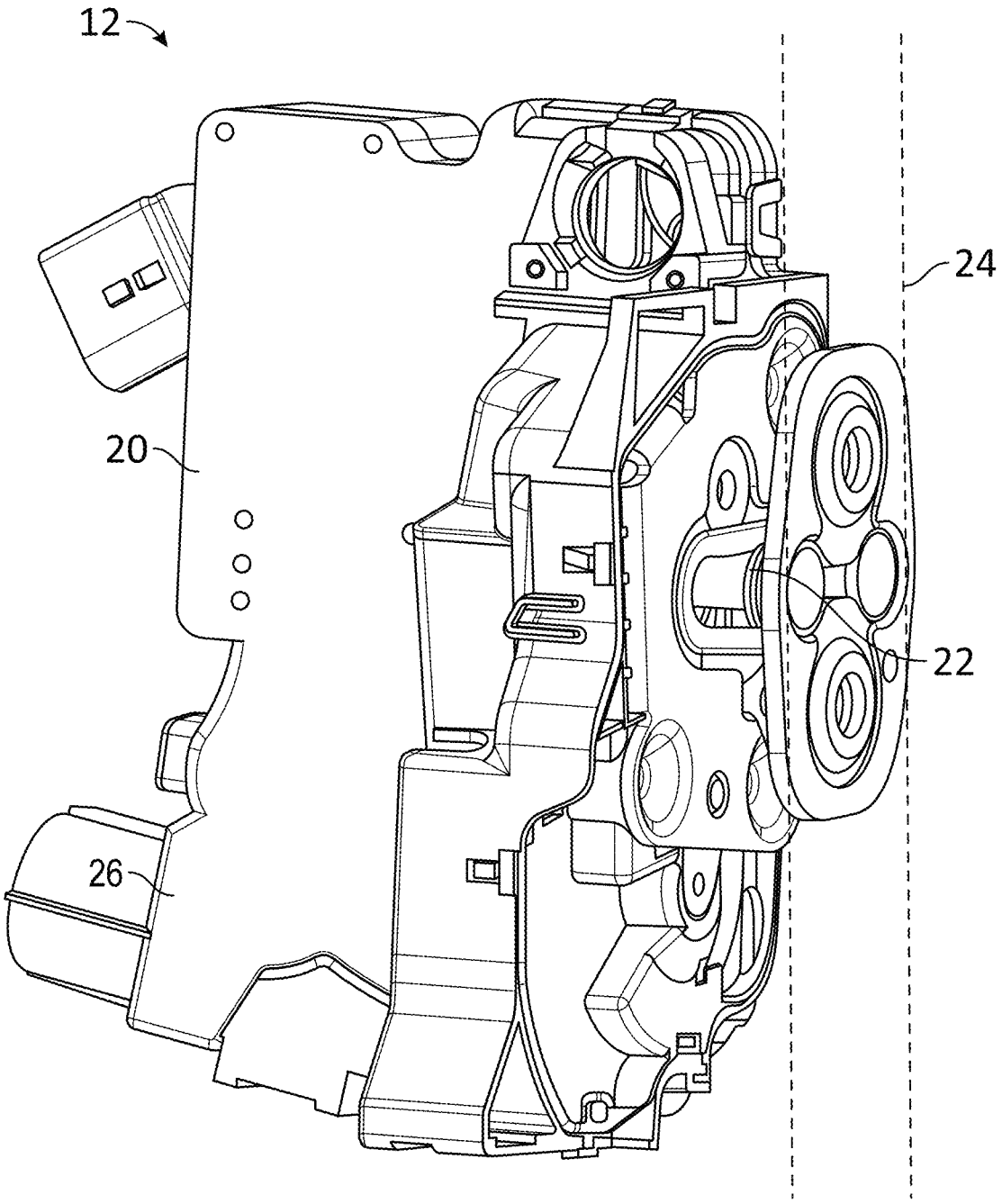
FIG. 2 is an illustration of an embodiment of a vehicle door latch assembly.

Referring to FIG. 2, the vehicle latch assembly 12 includes a latch 20 disposed at the vehicle door 11, and a latch striker 22 disposed at a fixed vehicle structure 24, such as a B-pillar or C-pillar of the vehicle. The latch 20 interfaces with the latch striker 22 to retain the vehicle door 11 in the completely closed position. The latch 20 and other components of the vehicle latch assembly 12 may be located in a latch housing 26. Further, the vehicle latch assembly 12 includes an inside release lever 28 (shown in FIG. 3) operable through connection with an inside release handle (not shown). The inside release lever 28, when operated, allows a user to operate the latch assembly 12 such that the latch 20 releases the latch striker 22 when the inside release lever 28 is actuated. This allows the vehicle door 11 to be opened by the user from inside of the vehicle.

Figure 3:
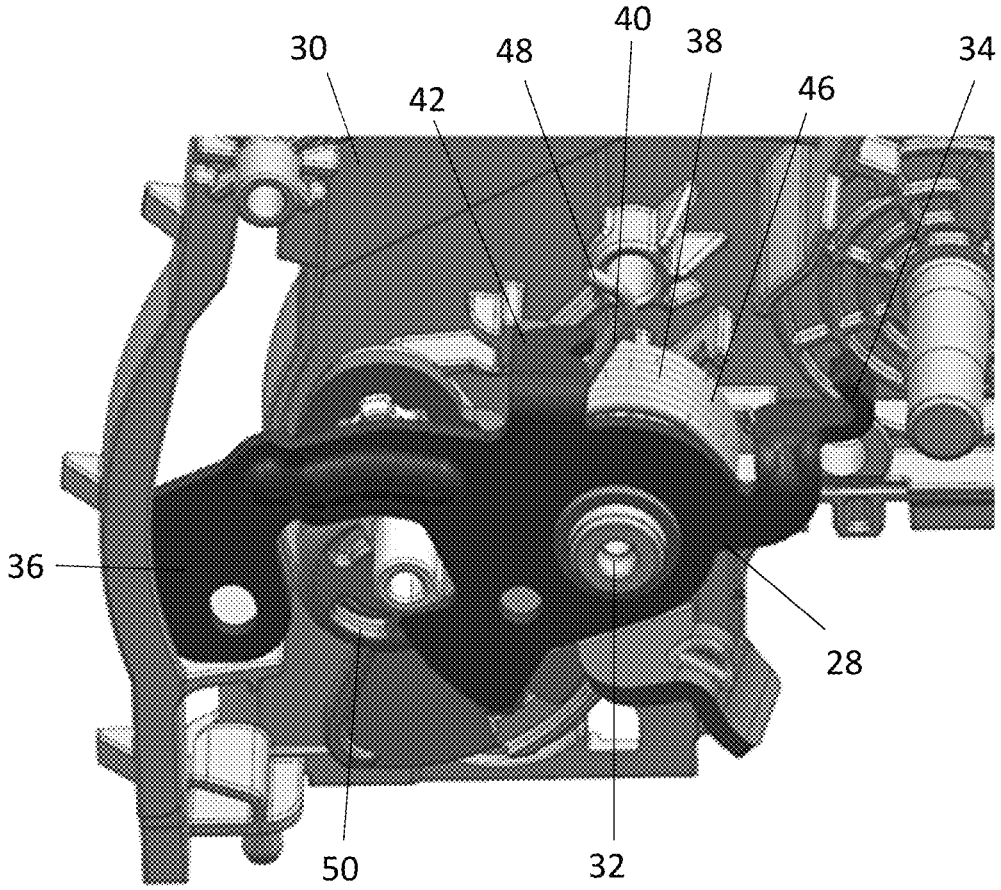
FIG. 3 is an illustration of an embodiment of an inside release lever and child lock lever arrangement of a vehicle door latch assembly.

Referring now to FIG. 3, the inside release lever 28 is rotatably fixed in a latch assembly housing 30 at, for example, an inside release pivot 32. The inside release lever 28 includes a first release arm 34 operably connected to the latch 20 and a second release arm 36 operably connected to the inside release handle. Further, a release spring 38 is located at the inside release pivot 32 and is operably connected to the inside release lever 28 to bias the inside release lever 28 to a closed position as shown in FIG. 3. The release spring 38 interacts with the inside release lever 28 via a first spring arm 40 of the release spring 38 via a third release arm 42.

Figure 4:
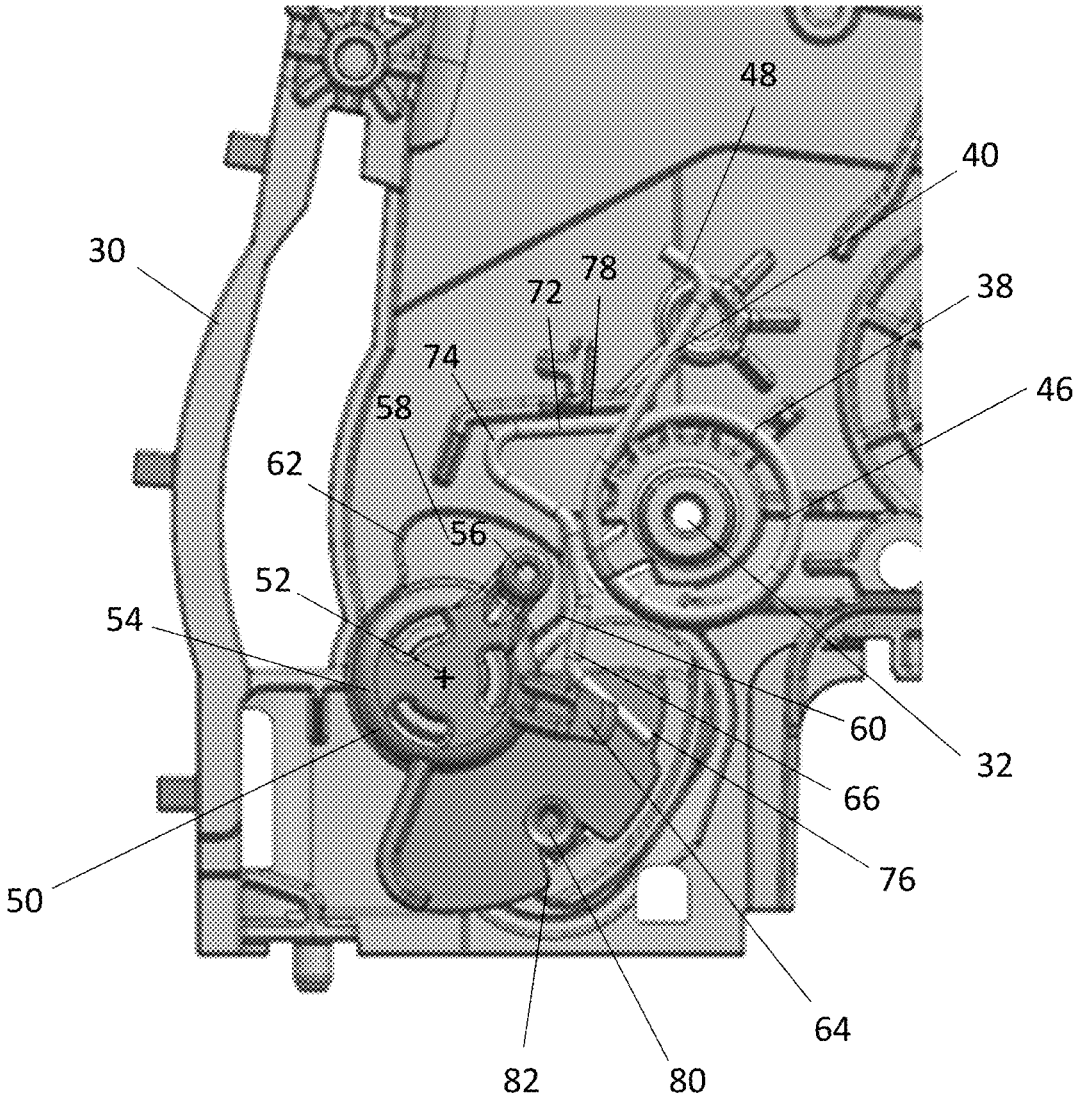
FIG. 4 is an illustration of an embodiment of a release spring and child lock lever arrangement of a vehicle door latch assembly.

Referring now to FIG. 4, the release spring 38 is a torsional spring with a spring axis located at the inside release pivot 32. The release spring 38 has a spring body 46 extending around the inside release pivot 32, and the first spring arm 40 extends tangentially outwardly from the spring body 46 at a first axial end 70 of the spring body. In some embodiments, a first spring arm tip 48 is located at an end of the first spring arm 40, and includes a bend or other feature to engage the inside release lever 28, as best shown in FIG. 3.

The release spring 38 biases the inside release lever 28 to a closed position due to the engagement of the first spring arm 40 to the third release arm 42 of the inside release lever 28. When a force is applied to the inside release lever 28 which overcomes the bias force of the release spring 38 by, for example, activating the inside release handle, the inside release lever 28 communicates with the latch 20 to release the latch striker 22.

The vehicle latch assembly 12 further includes a child lock lever 50 located in the latch assembly housing 30. The child lock lever 50 is located at and rotates about a child lock pivot 52. The child lock pivot 52 is separated from the inside release pivot 32 by a distance. The child lock lever 50 includes a lever body 54 and a first lock arm 56 extending therefrom. The first lock arm 56 is located in an arm recess 58 in the latch assembly housing 30 and is movable between a first recess end 60 and a second recess end 62 by rotation of the child lock lever 50 about the child lock pivot 52. The child lock lever 50 further includes a second lock arm 64 extending outwardly from the lever body 54. The second lock arm 64 contacts and is interactive with a second spring arm 66 of the release spring 38.

The second spring arm 66 extends tangentially from the spring body 46 at a second axial end 68 of the spring body 46, opposite the first axial end 70. A first arm portion 72 extends tangentially outwardly linearly to a knee portion 74 at which the second spring arm 66 changes direction, and extends to a second spring arm tip 76. The second spring arm tip 76 is in contact with the second lock arm 64. Further, the first arm portion 72 abuts a housing rib 78 so that loads applied to the second spring arm 66 through the second lock arm 64 are reacted at the housing rib 78 and not transferred to the spring body 46.

Figure 5:
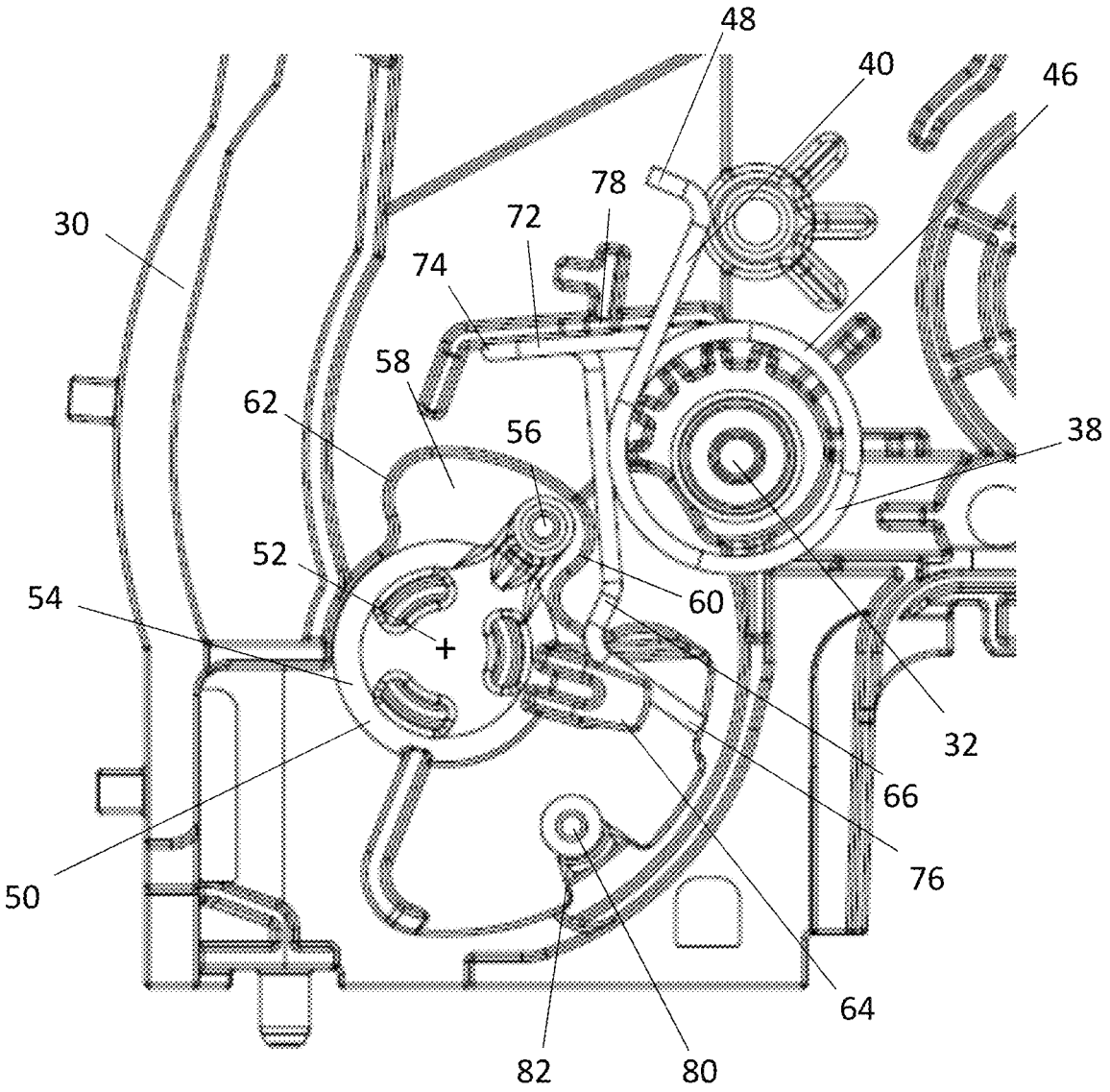
FIG. 5 is an illustration of an embodiment of a release spring and child lock lever arrangement where the child lock lever is in a first position.

A lock pin 80 extends into a pin slot 82 in the lever body 54, and is the input to move the child lock lever 50 between an engaged position and a disengaged position. When the child lock lever 50 is in the engaged position, the latch 20 will not release the latch striker 22 when the inside release handle is activated. Referring now to FIG. 5, the child lock lever 50 is shown in a first position, or engaged position. In this position, the second spring arm 66 engages the second lock arm 64 and biases the first lock arm 56 toward the first recess end 60. The force of the second spring arm 66 on the second lock arm 64 holds the child lock lever 50 in the first position.

Figure 6:
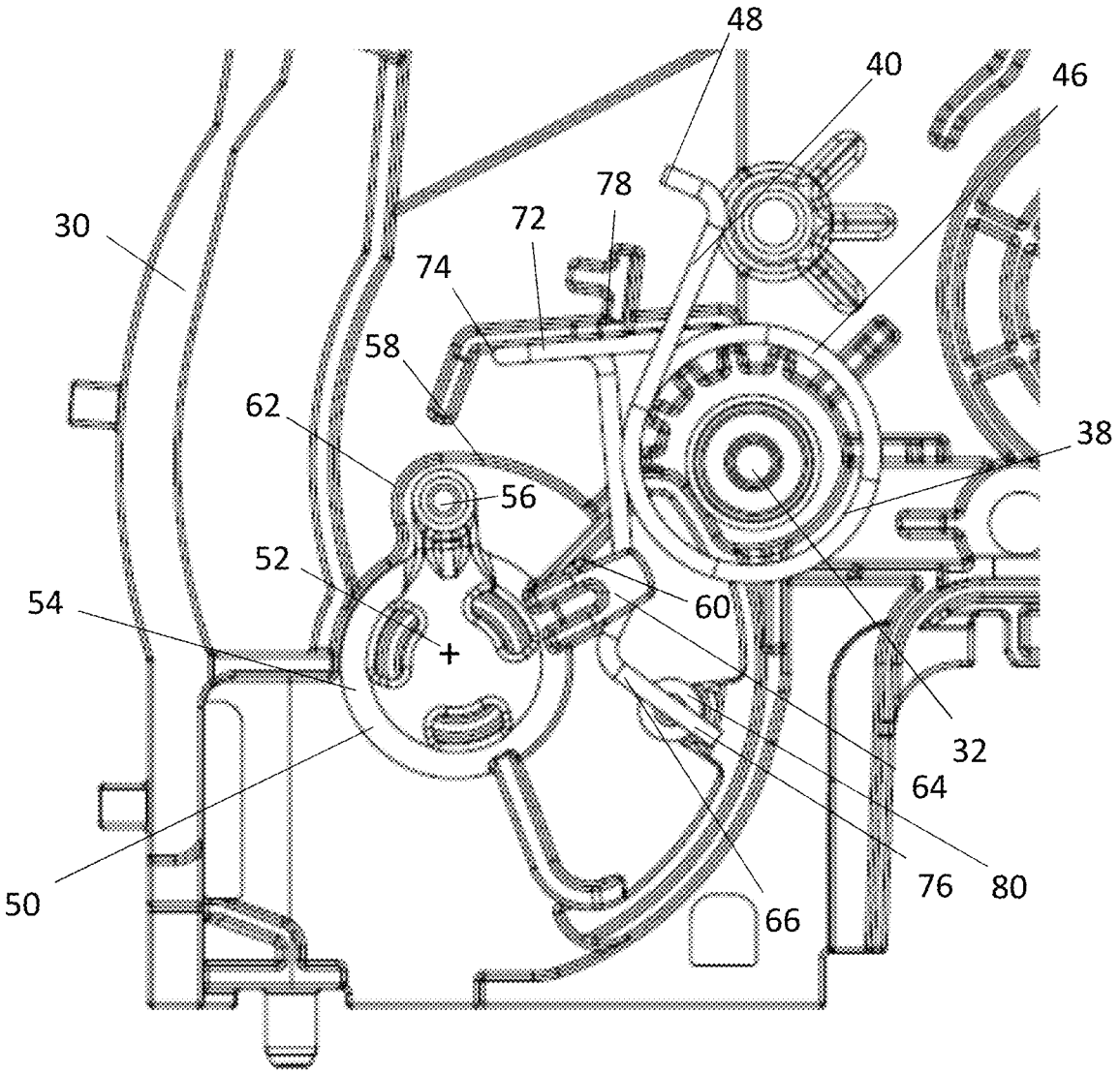
FIG. 6 is an illustration of an embodiment of a release spring and child lock lever arrangement where the child lock lever is in a second position.

Referring now to FIG. 6, shown is the child lock lever 50 in a second or disengaged position. To reach the second position, the child lock lever 50 is rotated about the child lock pivot 52 by movement of the lock pin 80 to overcome the bias of the second spring arm 66. In the second position, the second spring arm 66 biases the first lock arm 56 toward the second recess end 62. The force of the second spring arm 66 on the second lock arm 64 holds the child lock lever 50 in the second position.

Utilizing the second spring arm 66 to bias the position of the child lock lever 54, compared to a typical plastic beam, reduces variation in operating effort of the child lock lever 50, and improves function of the child lock lever 50. Further, the configuration reduces cost by combining the two parts.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A door inside release spring for a vehicle door assembly, comprising:

a torsional spring body;

a first spring arm extending from a first axial end of the spring body, the first spring arm configured to be operably connected to an inside release lever to bias a position of the inside release lever; and a second spring arm extending from a second axial end of the spring body opposite the first axial end, the second spring arm configured to be operably connected to a child lock lever to bias a position of the child lock lever;

wherein the second spring arm includes:

a first arm portion extending tangentially from the spring body;

a second spring arm tip extending in a direction non-parallel to the first arm portion; and a knee portion connecting the first arm portion and the second spring arm tip;

wherein the knee portion includes a bend in the second spring arm between the first arm portion and the second spring arm tip of greater than ninety degrees;

wherein the first arm portion is configured to abut a housing rib of a latch assembly housing such that the housing rib reacts loads applied to the second spring arm.

2. The door inside release spring of claim 1, wherein the second spring arm is configured to bend at the knee portion in response to forces applied at the second spring arm tip.

3. The door inside release spring of claim 1, wherein the first spring arm extends tangentially from the first axial end of the spring body.

4. The door inside release spring of claim 1, wherein the first spring arm is configured to be operably connected to the inside release lever at a first spring arm tip.

5. A door latch assembly, comprising:

a latch assembly housing;

an inside release lever disposed at the latch assembly housing and rotatable about an inside release pivot;

a child lock lever disposed at the latch assembly housing and rotatable about a child lock pivot; and a door inside release spring disposed at the housing, including:

a torsional spring body disposed at the inside release pivot;

a first spring arm extending from a first axial end of the spring body, the first spring arm operably connected to the inside release lever to bias a position of the inside release lever; and a second spring arm extending from a second axial end of the spring body opposite the first axial end, the second spring arm operably connected to the child lock lever to bias a position of the child lock lever;

wherein the second spring arm includes:

a first arm portion extending tangentially from the spring body;

a second spring arm tip extending in a direction non-parallel to the first arm portion; and a knee portion connecting the first arm portion and the second spring arm tip;

wherein the first arm portion abuts a housing rib of the housing, the housing rib reacting loads applied to the second spring arm.

6. The door latch assembly of claim 5, wherein the second spring arm is configured to bend at the knee portion in response to forces applied at the second spring arm tip.

7. The door latch assembly of claim 5, wherein the child lock lever includes:

a first lock arm disposed in a housing recess; and a second lock arm operably connected to the second spring arm tip.

8. The door latch assembly of claim 7, wherein the second spring arm tip selectably biases the first lock arm toward a first recess end of the housing recess or toward a second recess end of the housing recess.

9. A door latch assembly, comprising:

a latch assembly housing;

an inside release lever disposed at the latch assembly housing and rotatable about an inside release pivot;

a child lock lever disposed at the latch assembly housing and rotatable about a child lock pivot; and a door inside release spring disposed at the housing, including:

a torsional spring body disposed at the inside release pivot;

a first spring arm extending from a first axial end of the spring body, the first spring arm operably connected to the inside release lever to bias a position of the inside release lever; and a second spring arm extending from a second axial end of the spring body opposite the first axial end, the second spring arm operably connected to the child lock lever to bias a position of the child lock lever;

wherein the child lock lever includes:

a first lock arm disposed in a housing recess; and a second lock arm operably connected to the second spring arm tip; and wherein a direction of the bias of the first lock arm is selected based on a position of the child lock lever relative to child lock pivot.

10. The door latch assembly of claim 5, further comprising a lock pin to rotate the child lock lever about the child lock pivot.

11. The door latch assembly of claim 5, wherein the first spring arm extends tangentially from the first axial end of the spring body.

12. The door latch assembly of claim 5, wherein the first spring arm is operably connected to the inside release lever at a first spring arm tip.

13. The door latch assembly of claim 5, wherein the child lock pivot and the inside release pivot are separated by a distance.

* * * * *